US009146023B2

(12) United States Patent
Keser et al.

(10) Patent No.: US 9,146,023 B2
(45) Date of Patent: Sep. 29, 2015

(54) LIGHTING MODULE SOCKET THAT ACCOMODATES DIFFERENT VOLTAGES

(75) Inventors: Merijn Keser, Eindhoven (NL); Peter Johannes Martinus Bukkems, Eindhoven (NL); Vincent Stefan David Gielen, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 109 days.

(21) Appl. No.: 14/119,473

(22) PCT Filed: May 30, 2012

(86) PCT No.: PCT/IB2012/052697

§ 371 (c)(1),
(2), (4) Date: Nov. 22, 2013

(87) PCT Pub. No.: WO2012/168831

PCT Pub. Date: Dec. 13, 2012

(65) Prior Publication Data

US 2014/0092582 A1 Apr. 3, 2014

(30) Foreign Application Priority Data

Jun. 6, 2011 (EP) ..... 11168753

(51) Int. Cl.
*H01R 12/00* (2006.01)
*F21V 19/00* (2006.01)
(Continued)

(52) U.S. Cl.
CPC ..... *F21V 19/00* (2013.01); *F21V 19/003* (2013.01); *F21V 19/0005* (2013.01); *F21K 9/30* (2013.01); *F21V 23/005* (2013.01); *F21V 29/763* (2015.01);
(Continued)

(58) Field of Classification Search
CPC ... F21K 9/00; F21K 9/1355; F21K 2099/005; F21V 17/14; F21V 17/162; F21V 19/00; F21V 19/001
USPC ..... 439/57, 236, 611, 614, 619, 699.2; 362/84, 95, 228, 234, 249.02, 256
See application file for complete search history.

(56) References Cited

U.S. PATENT DOCUMENTS 5,378,158 A 1/1995 Owen
5,941,632 A 8/1999 Wedell et al.
(Continued)

FOREIGN PATENT DOCUMENTS

CN 101839416 A 9/2010
DE 102008008809 B3 4/2009
(Continued)

*Primary Examiner* — Vanessa Girardi
(74) *Attorney, Agent, or Firm* — Yuliya Mathis

(57) ABSTRACT

A lighting module comprising a light source, electrical contacting means electrically connected to the light source and a heat spreader in thermal contact with the light source, the socket comprising at least a first set and a second set of socket contact means for providing an electrical interface with the electrical contacting means of the lighting module, wherein the socket is configured to retain the lighting module in a predetermined position in which electrical contact between the electrical contacting means of the lighting module and one of the first and second set of socket contact means is achieved and electrical contact between the electrical contacting means of the lighting module and the other one of the first and second set of socket contact means is prevented. A lighting module to be received in the socket and a luminaire comprising a lighting module mounted in a socket.

12 Claims, 8 Drawing Sheets

(51) Int. Cl.

| | |
|---|---|
| *F21K 99/00* | (2010.01) |
| *F21V 23/00* | (2015.01) |
| *F21Y 101/02* | (2006.01) |
| *H01R 33/945* | (2006.01) |
| *F21V 29/76* | (2015.01) |
| *F21V 29/77* | (2015.01) |

(52) U.S. Cl.
CPC ..... *F21V 29/773* (2015.01); *F21Y 2101/02* (2013.01); *H01R 33/9456* (2013.01)

(56) References Cited

U.S. PATENT DOCUMENTS

| | | | | |
|---|---|---|---|---|
| 6,036,522 | A | 3/2000 | Holzer | |
| 6,271,629 | B1 | 8/2001 | Pace et al. | |
| 6,746,260 | B2 | 6/2004 | Chudkosky | |
| 7,407,418 | B1 * | 8/2008 | Harlan | 439/699.2 |
| 7,677,766 | B2 * | 3/2010 | Boyer | 362/294 |
| 7,988,336 | B1 * | 8/2011 | Harbers et al. | 362/294 |
| 8,033,682 | B2 * | 10/2011 | Catalano et al. | 362/202 |
| 8,702,437 | B2 * | 4/2014 | Fullerton et al. | 439/236 |
| 8,845,146 | B2 * | 9/2014 | Blankestijn et al. | 362/373 |
| 2010/0328946 | A1 | 12/2010 | Borkar | |
| 2011/0019409 | A1 | 1/2011 | Wronski | |
| 2013/0286669 | A1 * | 10/2013 | Moser et al. | 362/382 |

FOREIGN PATENT DOCUMENTS

| | | | |
|---|---|---|---|
| DE | 102008012472 | A1 | 10/2009 |
| EP | 2284440 | A1 | 2/2011 |
| JP | 9185978 | A | 7/1997 |
| WO | 9910955 | A1 | 3/1999 |

* cited by examiner

B - B

LIGHTING MODULE SOCKET THAT ACCOMODATES DIFFERENT VOLTAGES

CROSS-REFERENCE TO PRIOR APPLICATIONS

This application is a U.S. national stage application under 35 U.S.C. §371 of International Application No. PCT/IB2012/052697, filed on May 30, 2012, which claims priority to and the benefit of European Patent Application No. 11168753.9, filed on Jun. 6, 2011. These applications are hereby incorporated by reference herein.

FIELD OF THE INVENTION

The invention relates to a socket for receiving a lighting module and to the lighting module and a luminaire comprising the lighting module mounted in the socket.

BACKGROUND OF THE INVENTION

Light emitting diodes, LEDs, are employed in a wide range of lighting applications. As LEDs have the advantage of providing a bright light, being reasonably inexpensive and drawing very little power, it is becoming increasingly attractive to use LEDs as an alternative to traditional incandescent lighting. Furthermore, LEDs have a long operational lifetime. As an example, LED lamps may last 100 000 hours which is up to 20 times the operational life of an incandescent lamp.

However, even though LEDs have a long operational life, individual devices may fail and require early replacement or LED lamps may be replaced for reasons such as upgrading or alternating between different LED lamps. Therefore, serviceable and integrated LED modules with corresponding sockets for general lighting applications are introduced to the market, thereby enabling easy upgrades and replaceability of LED modules. Additionally, a modular system for LED devices provides the possibility to use LED modules from different suppliers.

Further, LED modules may be replaced and upgraded at the end of their operational life, or earlier, if e.g. a different color temperature is desired, without having to remove the reflector or open the ceiling.

One kind of LED module is the driver integrated LED module. The LED driver converts 120V (or other voltage) 60 Hz AC power to the low-voltage DC power required by the LEDs and protects them from line-voltage fluctuations.

The driver integrated LED modules are typically region specific, according to differences in legislation and the driver is designed specifically for the mains supply in a region. Typically 3 regions are defined: North America, Europe/APR and Japan, all having different mains supplies.

There is a risk involved by having different LED modules designed for different regions. If a region specific LED module is inserted in a holder in another region which has a different mains supply than the LED module is designed for, there is a risk of connecting a module to the wrong mains. This could happen if a module intended for Europe ends up in the US. In the least bad case the LED module just does not work, but in a worse case the LED module will be damaged. To mediate this risk, most prior art lighting products use a keying in the lamp holder and lamp base that differentiates between the different regions, resulting in a different lamp holder for North America, Europe/APR and for Japan. Besides this three-fold lamp holder development, the luminary maker also has to keep stock of lamp holders for each region it sells its products in.

Thus, there is still a need for a luminaire having a socket which can be used for two or more regions.

SUMMARY OF THE INVENTION

It is an object of the present invention to provide an improved lighting assembly and a socket for which can used in more than one region and which reduces the risk of connecting a LED module to the wrong mains supply.

According to a first aspect of the invention, this and other objects are achieved by a socket for receiving a lighting module comprising a light source, electrical contacting means electrically connected to the light source and a heat spreader in thermal contact with the light source, the socket comprising at least a first set and a second set of socket contact means for providing an electrical interface with the electrical contacting means of the lighting module, wherein the socket is configured to retain the lighting module in a predetermined position in which electrical contact between the electrical contacting means of the lighting module and one of the first and second set of socket contact means is achieved and electrical contact between the electrical contacting means of the lighting module and the other one of the first and second set of socket contact means is prevented.

By having two or more sets of socket contact means which provide an electrical interface to be connected to a lighting module, the socket may receive different kinds of lighting modules, for example, lighting modules adapted to different voltages. Each set of socket contact means can then be adapted to a specific voltage. For example the first set may be adapted to the voltage system in Europe and the second set to North America or Japan. A socket, which is configured to retain the lighting module in a predetermined position in which electrical contact between the electrical contacting means of the lighting module and one of the first and second set of socket contact means is achieved and electrical contact between the electrical contacting means of the lighting module and the other one of the first and second set of socket contact means is prevented, makes it possible to avoid an electrical connection between the lighting module and the socket if they are not adapted to the same voltage. As an example, only the first set of contact means may be connected to a mains supply with a specific voltage. A lighting module adapted to the same voltage will be arranged in the predetermined position and will make electrical contact. Another lighting module which is adapted to another voltage may be configured differently so it will make contact with the second set of contact means, and hence it will not make electrical contact with the connected mains supply. The connection to the mains supply may be accomplished by the installer. For example the installer may connect the mains supply directly to the set of socket contact means adapted to the same voltage, i.e. both sets of socket contact means are available to connect to the mains supply. As an alternative, only one of the sets of socket contact means is reachable to the installer, i.e. the socket may be pre-connected internally to the set of socket contact means which shall be connected to the mains supply i.e. the installer has only one single option to connecting the mains. The socket is then adapted to a specific voltage. Alternatively, all sets of socket contacts may be connected in parallel.

In the present context, the electrical contacting means may for example be electrically conductive connector pins for providing power to the light source or electrical contact plates. Furthermore, the electrical contacting means may also comprise contacts for control of and communication with the lighting module. However, the electrical contacting means may also comprise different electrical contacts such as connectors or battery contacts.

The heat spreader may be a metallic plate providing good thermal conductivity for efficient transfer of heat generated by the light source. However, alternative designs of the heat spreader and other materials compositions providing sufficient thermal conductivity may also be used such as metal alloys, thermal epoxy, diamond or other carbon based materials.

The light source may advantageously be one or more light emitting diodes (LEDs). LEDs may advantageously be selected over other light sources as they are a cost-efficient alternative as a result of low power consumption and long operational lifetime. Furthermore, as LEDs can be made small the overall size of the lighting assembly may be reduced in comparison with lighting assemblies using incandescent light sources.

According various embodiments the predetermined position may be defined by the location of one of the first or second set of socket contact means on the socket. If the first or the second set of socket contact means defines the predetermined position there may be no need for a separate means to correctly position the lighting module.

According to at least one exemplary embodiment the first set and the second set of socket contact means may be electrically connectable to the electrical contacting means of the lighting module through rotation of the lighting module.

According to at least one exemplary embodiment the second set of socket contact means of the socket may define a second predetermined position of the lighting module in the socket when the first set of contact means defines the first predetermined position. This enables the second set of socket contact means to define a second predetermined position for the lighting module, hence there is no need for a separate means to correctly position the lighting module so that it can make contact with the second set of socket contact means.

According to at least one exemplary embodiment the socket may comprise a track in which the first set and/or the second set of socket contact means are arranged and at least one of the first set and the second set of socket contact means may be accessible through at least a part of the track. One embodiment may be a socket with two different tracks and each comprises a set of socket contact means. An alternative embodiment may be one track where both sets of socket contact means is arranged into.

According to at least one exemplary embodiment the track may have a first and a second side track from a common track and the first set of socket contact means may be provided in the first side track and the second set of socket contact means may be provided in the second side track. This way different lighting modules may be arranged in to the same track and then the installer chooses which side track to use, i.e. which set of socket contact means shall be connected. In order to avoid arranging the lighting module in the wrong position, a stop may be incorporated in the socket and/or light module which only admits a lighting module, which is adapted to the same voltage, to electrically connect to the right set of socket contact means. All sets of socket contact means may be connected in parallel thereby preventing the risk of a faulty connection of socket contacts by the installer.

According to at least one exemplary embodiment the first set and the second set of socket contact means may be reached through rotation in different directions.

According to at least one exemplary embodiment the first set of socket contact means may comprise a first anode and a first cathode arranged in the socket at a first angular distance and the second set of contact means may comprise the same first anode and a second cathode arranged at a second angular distance and the electrical contacting means of the lighting module may comprise a lighting module anode and a lighting module cathode in a position corresponding to position of the first anode and first or second cathode of the first set or second set of socket contact means in order to make electrical contact with the corresponding first anode and first or second cathode. This allows many different lighting modules to be connected to the socket, hence many different mains voltages, AC as well as DC, which makes the socket more future proof.

According to at least one exemplary embodiment the first and second set of socket contact means may be slide connectors or spring loaded contacts. These are connectors of the shelf. These slide connectors could also function as retainer springs to improve thermal contact between lighting module and socket, or lighting module and heat spreader, or lighting module and heat sink.

According to at least one exemplary embodiment the socket has a central axis and the first set and the second set of socket contact means may be electrically connectable with the electrical contacting means of the lighting module through connection in the axial direction of the socket. This enables an easy assembly. For example, two electrically conductive connector pins can be inserted into matching holes in the socket when inserting the light module into the socket in the axial direction of the light module. Another alternative are electrical plate contacts forming the first and the second set of socket contact means which can be placed in contact with plate contacts on the lighting module which during assembly are arranged on top of each other by a linear placement of the lighting module in the socket, i.e. in the axial direction of the socket.

According to at least one exemplary embodiment the first set of socket contact means may comprise two openings and the second set of socket contact means may comprise two openings, and each set of socket contact means may be adapted to receive two mutually matching electrical contacting means of the lighting module.

According to at least one exemplary embodiment the electrical contacting means of the lighting module may be electrically conductive connector pins.

According to at least one exemplary embodiment a lighting module may be received in a socket as described above, the lighting module may comprise a light source, electrical contacting means electrically connected to the light source and a heat spreader in thermal contact with the light source, wherein the electrical contacting means may be arranged to connect with the first or the second set of contact means of the socket when received by the socket in the predetermined position.

According to at least one exemplary embodiment the electrical contacting means may be electrically conductive connector pins.

According to at least one exemplary embodiment the electrical contacting means may be electrical contact plates.

According to at least one exemplary embodiment the light source may be a light emitting diode. LEDs are a cost-efficient as a result of low power consumption and long operational lifetime. Furthermore, as LEDs can be made small the overall size of the lighting assembly may be reduced in comparison with lighting assemblies using incandescent light sources.

According to at least one exemplary embodiment a luminaire may comprise a lighting module as described above in any of the exemplary embodiments mounted in a socket which is described above in any of the matching exemplary embodiments.

It is noted that the invention relates to all possible combinations of features recited in the claims.

BRIEF DESCRIPTION OF THE DRAWINGS

This and other aspects of the present invention will now be described in more detail, with reference to the appended drawings showing embodiment(s) of the invention.

DETAILED DESCRIPTION

The present invention will now be described more fully hereinafter with reference to the accompanying drawings, in which example embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1:
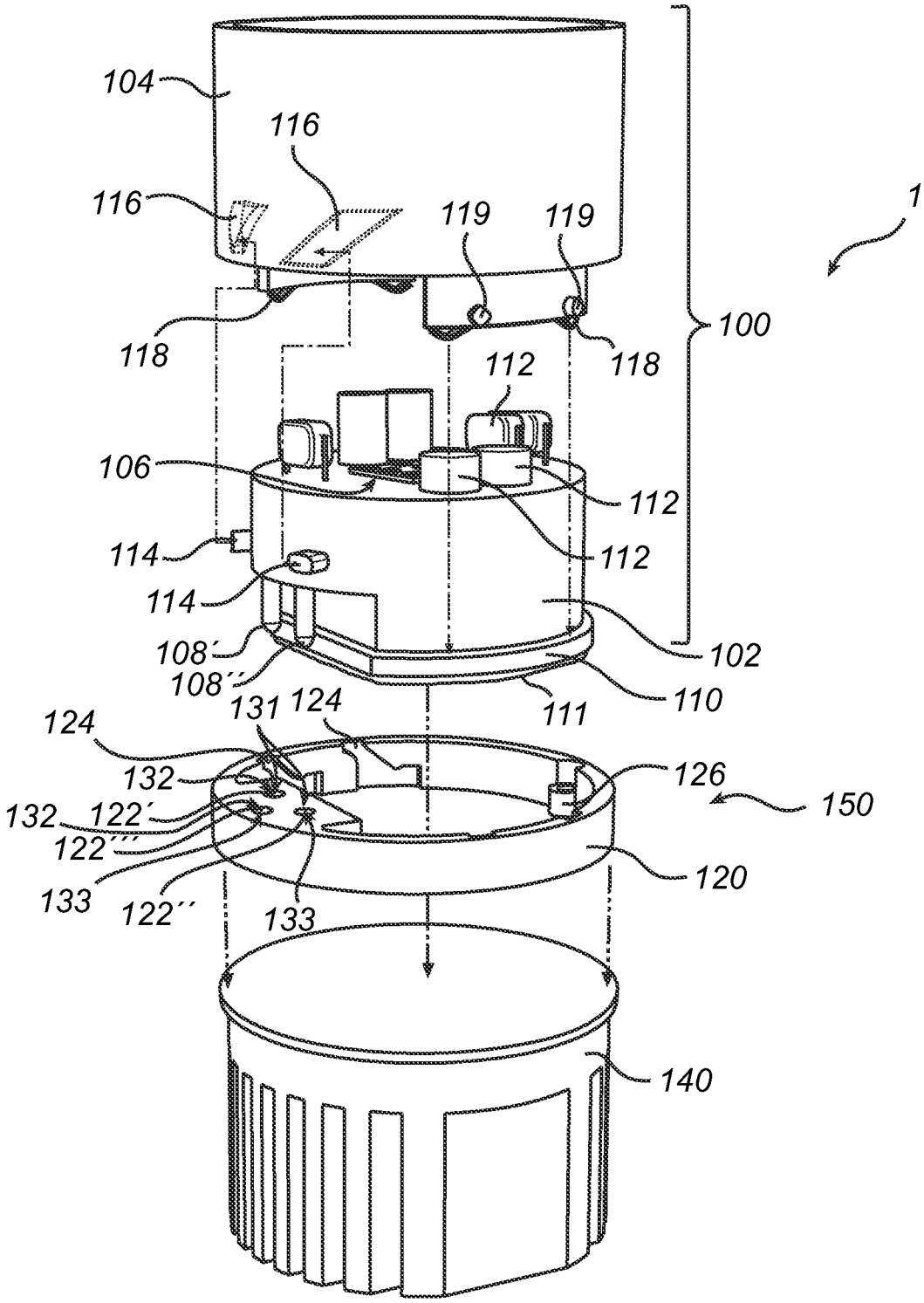
FIG. 1 schematically illustrates a luminaire according to a first embodiment of the present invention with connector pins in a first position.

FIG. 1 schematically illustrates a luminaire 1, according to a first embodiment, comprising a lighting assembly 100. The lighting assembly 100 comprising a lighting module 102 and a connector 104 configured to be connected to a socket 150 having a collar shaped portion 120. The collar shaped portion is arranged to a heat sink 140. The lighting module 102 comprises a LED light source 106, two electrical contacting means 108', 108" in the form of electrically conductive connector pins 108', 108" connected to the LED 106 and a heat spreader 110 which is in thermal contact with the LED 106. In the present example, two electrically conductive connector pins 108', 108" are configured to provide contact to a power source. The two pins are arranged next to each other. A layer of thermal interface material (TIM) 111 is arranged on the heat spreader 110 on the side facing the heat sink 140. The heat sink 140 is provided with fins for efficient transfer of heat from the heat sink 140 to the surrounding air.

The lighting module 102 is further equipped with electronics 112 for controlling the LED 106. The connector 104 is shaped as an essentially cylindrical housing encompassing the lighting module 102. The guiding pins 114 arranged on the outside of an essentially cylindrical portion of the lighting module 102 are configured to fit in corresponding guiding slots 116 arranged on the inside of the connector 104. Alternatively, the guiding pins may be arranged on the connector in which case the guiding slots are arranged in the lighting module. The guiding pins 114 and guiding slots 116 keep the lighting module and the connector together and they also allow the connector 104 to rotate and move in an axial direction in relation the lighting module 102. Only as much rotation and axial movement as is needed for installation of the lighting assembly 100 into the socket 150 is allowed. Furthermore, spring means, here in the form of leaf springs 118, are arranged on a lower portion of the connector 104. The connector is also equipped with fastening pins 119 forming the male portion of a bayonet coupling for fastening the lighting assembly 100 to the socket 150. It is however realized that the lighting module 102 can be arranged to the socket 150 in any other suitable way, for example by using screws.

Moreover, the collar shaped portion 120 of the socket 150 is equipped with three receiving contact means 122', 122" and 122'" in the form of three openings, a first opening 122', a second opening 122" and a third opening 122'" for axially receiving the connector pins 108', 108" and they are arranged to each other in a triangular shape, where each opening is arranged in the corner of the triangle. The openings are not limited to this arrangement, they may for example be arranged in a row or any other suitable position. The first opening 122' and the second opening 122" form a first set of socket contact means 131 and the first opening 122' and the third opening 122'" form a second set of socket contact means 132 and the second opening 122' and the third opening 122'"form a third set of socket contact means 133.

The three sets 131, 132, 133 of contact means provide three different electrical interfaces which may work with three different lighting modules. Each set of socket contact means can be connected to a mains supply (not shown), through for example wires (not shown). Each set of socket contact means 131, 132, 133 works at a predetermined voltage and set of socket contact means is adapted to a different voltage. For example, the first set 131 may be adapted to the mains supply in North America, the second set 132 may be adapted for Europe and the third set of socket contact means 133 may be adapted to the mains supply in Japan. When mounting the socket 150, for example to a ceiling in North America the installer may connect the mains supply to the first set of socket contact means 131 and when arranging the lighting module 102 suitable for North America, shown in FIG. 1, its two connector pins 108', 108" will only fit into the two openings 122', 122", which forms the first set of socket contact means 131. These connector pins 108', 108" are also adapted to the same voltage as the mains supply and a safe and adequate electrical connection is made.

Figure 2A:
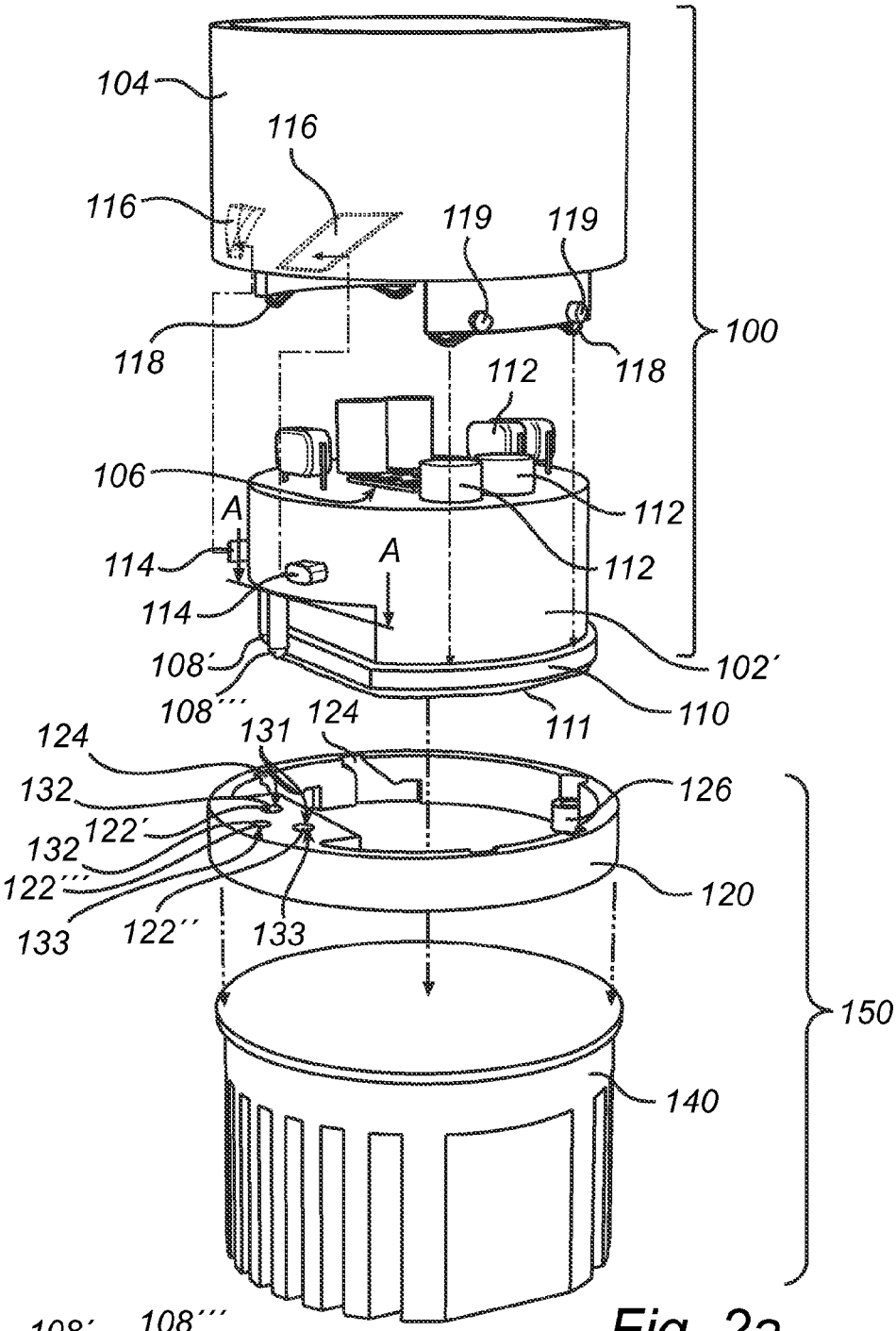
FIG. 2*a* schematically illustrates a luminaire according to the first embodiment of the present invention, with connector pins arranged in a second position.
Figure 2B:
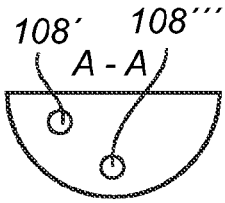
FIG. 2*b* schematically illustrates the second position of the connector pins in cross-section view A-A in FIG. 2*a*.

FIGS. 2*a* and 2*b* show how, for example, a European adapted lighting module 102' may have it pins arranged in such a way that, when fitted into the socket 150, the pins 108' and 108'" will only connect to the second set of socket contact means 132 i.e. the first and the third opening 122', 122'". FIG. 2*b* shows the area of the pins 108', 108'" on the lighting module 102 when viewing the electrical contact area of the lighting module 102 at the cross-section A-A in FIG. 2*a*.

Figure 3:
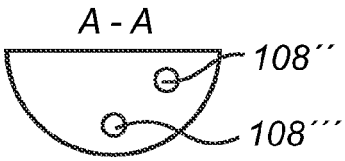
FIG. 3 schematically illustrates a third position of the connector pins in cross-section view A-A of FIG. 2*a*.

FIG. 3 shows the area of the pins 108", 108'" on the lighting module 102, when the lighting module 102, for example, is adapted for Japan when viewing the lighting module 102 at the cross-section A-A in FIG. 2*a*. The pins are now arranged differently.

When the lighting module 102 has it pins arranged like this, the pins 108", 108'" will only connect to the third set of socket contact means 133 in FIGS. 1 and 2*a* i.e. the second and the third opening 122", 122'" when the lighting module 102 is fitted into the socket 150, If the exemplified European lighting module 102' as configured in FIG. 2*a*, 2*b* is arranged to the socket 150, which is electrically connected to the mains supply as described above, i.e. the first set of socket contact means 131 which is, exemplified as adapted and connected to the mains supply in North America, the pins 108', 108" of the European lighting module will not connect to the first set of socket contact means 131, which are connected to the mains supply. In this case no electrical connection is made, because the pins 108', 108" will be arranged into the openings 122', 122'", i.e. the second set of socket contact means 132, where no electrical contact to the mains supply is made. This also applies the other way around, i.e. in the case that a socket is arranged for Europe and the European set of connector means are connected to the European mains supply and a Japanese or a North American lighting module is arranged to the European connected socket.

Further, the socket has L-shaped recesses 124 forming the female portion of a bayonet coupling for fastening the lighting assembly 100 to the socket 150. The socket 150 also has features in the form of openings 126 for screwing the collar shaped portion 120 of the socket 150 to the heat sink 140.

The mounting of the lighting assembly 100 into the socket 150 can be done in the following way. First, the lighting assembly 100 is axially inserted into the socket 150. The form of the opening in collar shaped portion 120 of the socket 150 corresponds to the form of the heat spreader 110 and the connector pins 108 are thereby correctly aligned to be axially inserted into the receiving contacting means 122. Simultaneously, the fastening pins 119 are axially inserted into the L-shaped recesses 124, together forming a bayonet coupling. Next, a rotational motion of the connector 104 in relation to the socket 150 and in relation to the lighting module 102 closes the bayonet coupling, simultaneously moving the connector 104 in the axial direction in relation to the socket 150 and the lighting module towards the heat sink 140. As the connector 104 is moved towards the heat sink 140, the leaf springs 118 in the connector 104 apply a force on the heat spreader 110 in the axial direction, thereby pressing the heat spreader 110 against the heat sink 140 forming a good thermal contact. Since the heat spreader 110 is fixed to the lighting module 102, the lighting module is also moved in the axial direction in relation to the connector. This combined rotational and axial movement of the lighting module in relation to the connector is controlled by the guiding slots 116 in the connector and the corresponding guiding pins 114 in the lighting module. As said above it is realized that the lighting module 102 can be arranged to the socket 150 in any other suitable way, for example by using screws.

Figure 4:
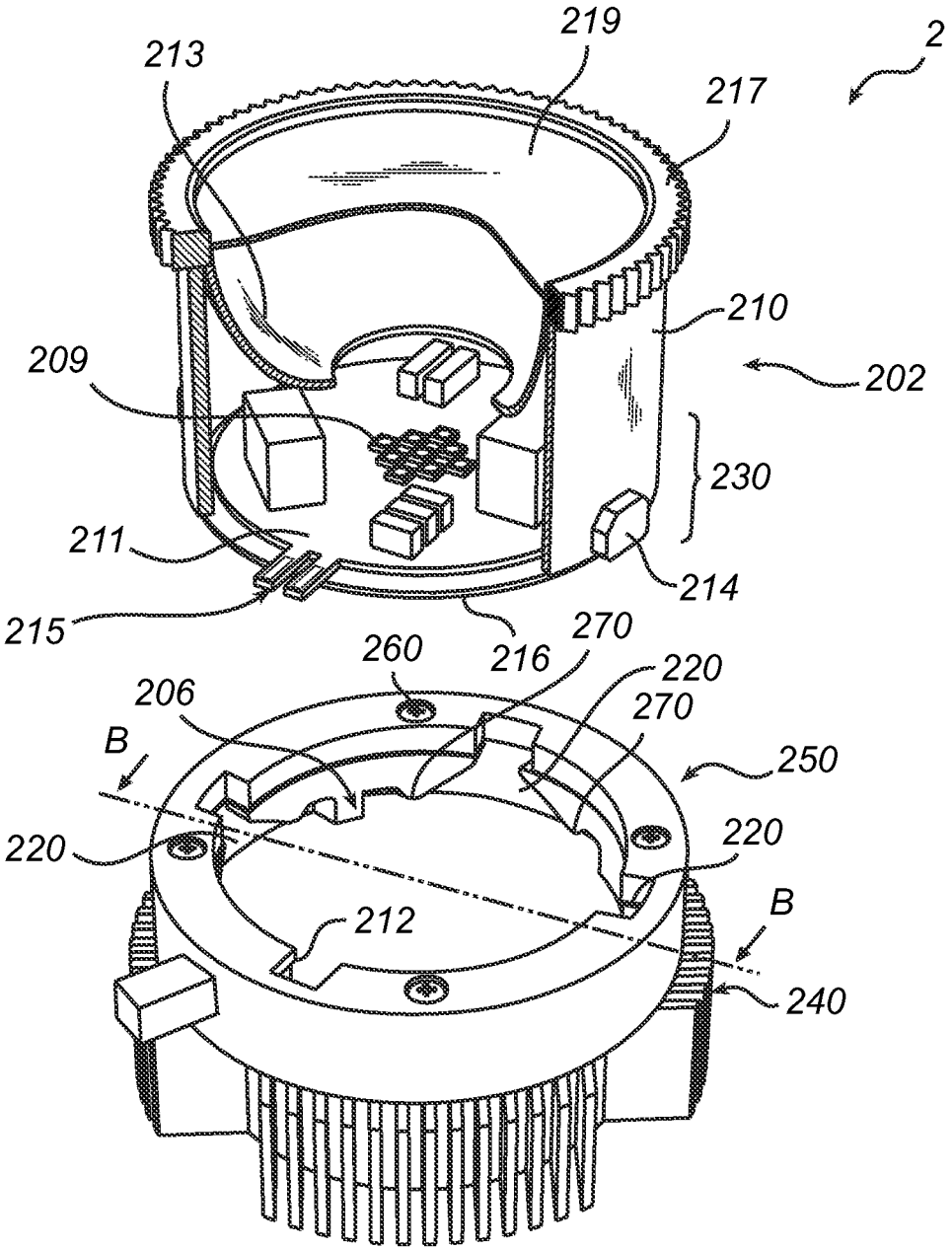
FIG. 4 schematically illustrates a luminaire according to a second embodiment of the present invention.

FIG. 4 schematically illustrates a second embodiment of a luminaire 2, comprising a socket 250 and a lighting module 202. The socket, here referred to as a lamp holder 250, is formed as a receiving part of a bayonet coupling enclosing a circular opening 206 for receiving the lighting module 202. The lamp holder 250 is here mounted to the heat sink 240 with screws 260. Thus, as the lighting module 202 is connected to the lamp holder 250, a thermal interface of the lighting module, provided at the bottom of the lighting module, is in direct contact with the heat sink 240, thereby enabling heat dissipation from the lighting module 202 to the heat sink 240.

The lighting module 202, here referred to as an LED module 202, comprises a cylindrical housing comprising a bottom surface 216, a side wall 210, and a top surface 219. The top surface is here a phosphor disc 219 for allowing light from the LED module to escape. The housing contains a plurality light emitting devices 209, here being LEDs 209 arranged on a printed circuit board 211. The number and type of LEDs may vary depending on the application, but is in this embodiment nine high power LEDs, each having a power of about 1 W. The LED module 202 may also include a cavity 213 for beam shaping, and a grip ring 217 which a user may grab when the LED module is connected/disconnected to the lamp holder 250.

Further, a bottom portion 230 of the LED module 202 forms a cylindrical plug 230, here referred to as lamp cap, adapted to be received by the lamp holder 250. A set of external radial protrusions 214 arranged on the side wall 210 form fastening pins 214 for mechanically connecting the LED module 202 to the lamp holder 250. Here, there are three fastening pins, but the number of fastening pins may vary.

The bottom portion 230 is also provided with an electrical interface 215, i.e. electrical contact means, which enables the LED module 202 to be electrically connected to an external power supply (AC or DC). The electrical interface is here in the form of two electrical contacts 215. The electrical contacts 215, which in this embodiment are arranged next to each other, extends radially from the housing 210. Arranging the electrical contacts 215 next to each other (rather than on opposite sides of the housing) saves space on the printed circuit board, and reduces electromagnetic interference (EMI). As illustrated in FIG. 4, the electrical contacts 215 may preferably be made directly onto the printed circuit board 211, thereby avoiding further components and costs.

The bottom portion 230 is provided with a thermal interface 216 for thermally connecting the LED module to the heat sink 240. The thermal interface 216 of the LED module is here a flat copper plate arranged to form the bottom of the LED module 202. Other materials having a high thermal conductivity such as carbon, an aluminum alloy, thermally conductive plastic or ceramics may also be used for the thermal interface 216. The flat copper plate 216 is in thermal contact with the LEDs 209, e.g. by means of a series of thermal vias provided in the printed circuit board 211. The area of the thermal interface 216 is designed to enable sufficient heat to be dissipated from the LED module 202 to the heat sink 240. In the illustrated example, the thermal interface 216 constitutes essentially the entire bottom surface of the LED module 202.

Figure 5:
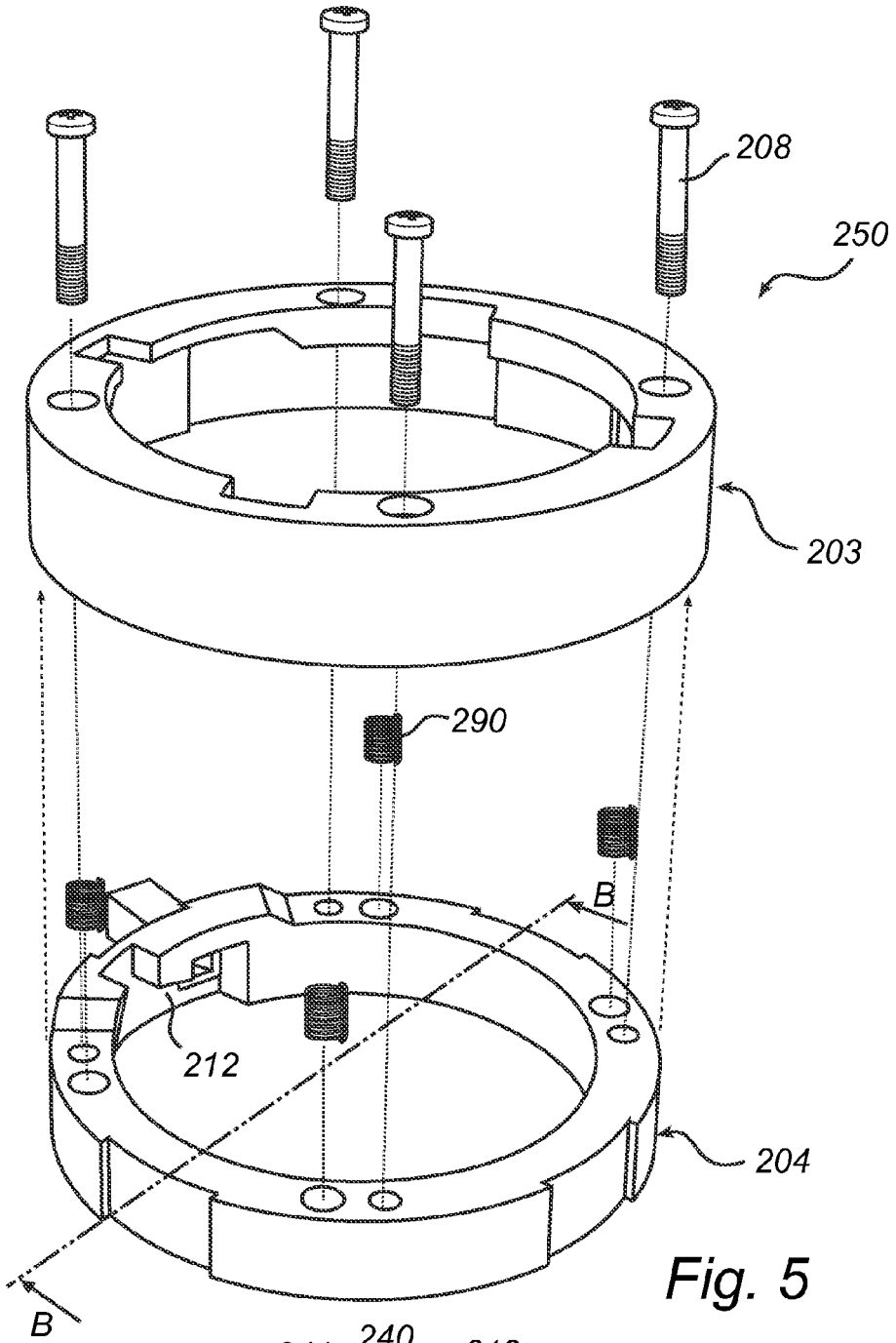
FIG. 5 schematically illustrates the socket of FIG. 4.

FIG. 5 schematically illustrates a more detailed view of the lamp holder 250 in FIG. 4. The lamp holder 250 comprises a first annular member 203 and a second annular member 204, both of which can be made of thermally non-conductive material such as plastic. The first annular member 203 is firmly mounted to the heat sink 240 by screws 208, whereas the second annular member 204 is resiliently supported in relation to the first annular member 203. The resilient support is in this embodiment achieved by a set of springs 290, here being four coil springs, arranged between the first 203 and second 204 annular members. However, the number and type of springs may vary. For example, a leaf spring may be used. Furthermore, the resilient support may also be achieved using other types of elastic elements. For example, instead of using a spring, a cylinder made of silicon rubber may be used.

Figure 5A:
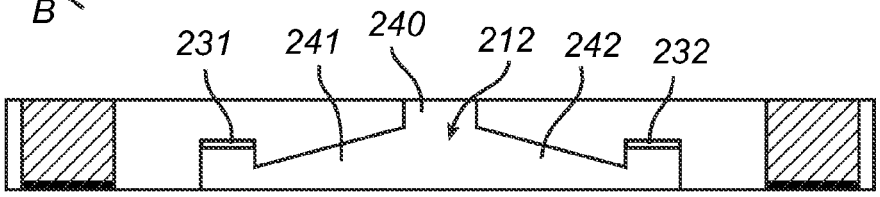
FIG. 5*a* schematically illustrates the recess in the socket of FIGS. 5 and 4 seen from cross-section B-B.

The second annular member 204, here being a plastic ring, is provided with a track 212 in which a first set 231 and a second 232 set of socket contact means are arranged in and the first set and the second set of socket contact means are reached through rotation of the lighting module when the lighting module is guided in the track to a mounted position. The track 212 has a first and a second side track from an insertion position and they are in arranged in opposite directions and in the end of the first side track is the first set of socket contact means provided and the second set of socket contact means is provided in the end of the second side track. The first and second set of socket contact means are in the shape of two contact plates. FIG. 5*a* shows the track at the cross-section view B-B in FIG. 5. The track 212 can be seen as an upside-down T-shaped recess 212 on the inner circumferential side of the socket. The track/recess 212 is arranged to receive the electrical contacts 215 of the LED module 102 and to guide the lighting module in a rotational movement to the electrical connecting positions. The contact plates can be made from copper, or some other electrically conductive material, and can be electrically connected to a power supply circuitry in a luminaire.

The upside-down T-shaped recess i.e. the track 212 has its opening facing the lighting module 202 connecting side in FIG. 4, such that the electrical contact 215 of the lighting module 202 in FIG. 4 can be introduced into the upside-down T-shaped recess/track in an axial direction of the socket. The track 212 is provided with a first 241 and a second 242 side track which are arranged in opposite positions from each other on the opposite side of the opening, i.e. the common opening/insert 240, giving the track 240 its upside-down T-shaped shape. The first set of socket contact means 231 is provided in the end of the first side track 241 and the second set 232 of socket contact means is provided in the end of the second side track 242.

Each set of socket contact means 231, 232 is adapted to a predetermined voltage and they are both adapted to different voltages. For example, the first set 231 may be adapted to the mains supply in North America and the second set 232 may be adapted to the mains supply for Europe or Japan. When mounting the socket 250, for example, to a ceiling in North America the installer connects the mains supply to the first set of socket contact means 231. When the lighting module 202, i.e. the LED module for America, is arranged in the socket 250 its electrical contacts 215 will make electrical contact with the first set of socket contact means 231, which is connected to the mains supply. If the lighting module 202 is twisted so that it connects the second set of socket contact means 232, there will be no electrical contact since the second set of socket contact means 232 is not electrically connected to the mains supply. The socket 250 and the recess 212 may be so designed that, dependent on where it shall be used, it has a twist stop so that a lighting module 202 cannot be twisted to the set of socket contact means which is not suited for that area. That is, a socket to be used in North American may have a of twist stop which allows lighting modules for North America only be twisted to the right set of socket contact means, i.e. here the first set of socket contact means. As an alternative, the recess/track 212 or the lighting module 202 could be designed in such a way that, if a European adapted lighting module is arranged into a North American connected socket, the lighting module 202 may be twisted in both ways, but if twisted to the first set of socket contact means, which is adapted to North American mains supply, the electrical contacts of the European will not make contact with the contacts in the first set of socket contact means. In this embodiment the first and the second set of socket contact means determine the positions, i.e. predetermined positions, of the lighting module in which electrical contact between the electrical contacting means of the lighting module and one of the first and second set of socket contact means is achieved.

The LED module 202 is connected to the lamp holder 250 by the fastening pins 214 are introduced into upside-down shaped recesses 220 (see FIG. 4), whereas the electrical contacts 215 of the LED module will fit into the upside-down T-shaped recess 212. Next, the LED module 202 is twisted clockwise or counter clockwise. As the LED module 202 is twisted, the fastening pins 214 presses the second annular member 204 upwards, thereby compressing the springs 290. As the fastening pins 214 pass the shoulders 270, the user will feel the LED module click into place, and the shoulders 270 will lock the fastening pins 214 in their end positions In this position, the electrical contact plates in the lamp holder will be in contact with the electrical contacts 215 of the LED module. It can be noted that the fastening pins are sufficiently high for the second annular member not to be in contact with the heat sink 240. Thus, the second annular member 204 will press the fastening pins 214 in the direction of the heat sink 240, whereby the thermal interface 216 (i.e. the bottom surface) of the LED module is pressed against the upper surface 226 of the heat sink 240.

The springs 290 may be configured such that a predetermined pressure is applied to the fastening pins 214, whereby the predetermined pressure can also be achieved between the thermal interface 216 of the LED module and the heat sink 240.

It can further be noted that as the opening 206 in the lamp holder 250 is a through-hole, there is a direct contact between the thermal interface 216 of the LED module and the heat sink 240, i.e. the lamp holder 202 is not in the thermal path.

To facilitate the twist-movement, the thermal interface 216 of the LED module may comprise a layer with a first adhesive side attached to the copper plate of the LED module and a second side, facing the heat sink, that provides ample lubrication for the twist movement. Examples of such a layer are a metal film with silicon adhesion, such as Laird T-Flex 320H, or a graphite foil, such as GrafTech HI-710. Furthermore, by using an interface layer, such as the Laird T-Flex 320H, which is compressible (in thickness), a thermal interface is achieved that is robust against scratches, dust and other particles. According to an alternative embodiment, such a layer may be provided at the heat sink.

Further, to ensure good thermal transfer between the thermal interface 216 of the LED module and the heat sink 240, adequate pressure should preferably be applied. Most thermal interface materials require about 10 PSI (pound-force per square inch) to provide good thermal transfer, but Laird T-Flex 320H can be used with a lower pressure (about 2.5 PSI). A lower pressure may be advantageous because the user needs to generate the torque, when twisting in the module, that creates this pressure. The desired pressure can be achieved, for example, by adjusting the number of springs in the lamp holder and their spring constants. It should be realized that the lighting module 102 can be arranged to the socket 250 in any other suitable way, for example by using screws.

Figure 6A:
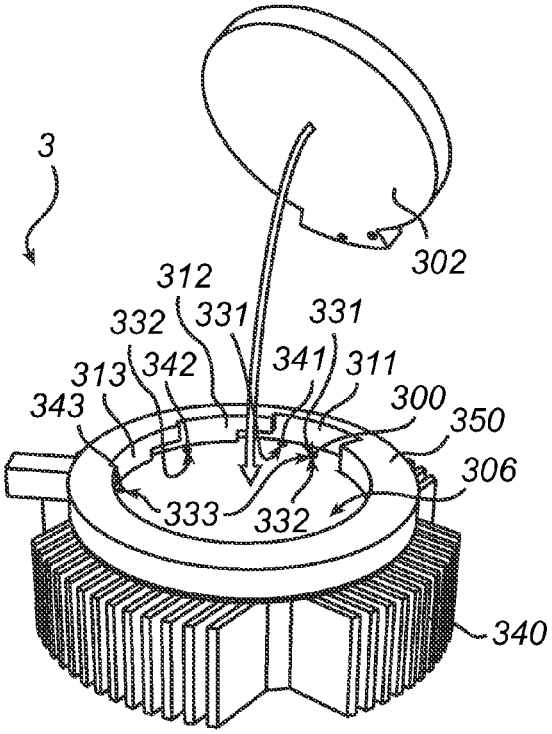
FIGS. 6*a*-6*c* schematically illustrate a lighting assembly according to a third embodiment of the present invention.

FIG. 6*a* shows a third embodiment of the luminaire 3. It discloses a socket 350 for connecting a lighting module 302 to a heat sink 340. The lighting module 302 is illustrated by only showing the bottom part of it and the electrical interface. The lighting module 302 may be designed in a similar way as the lighting module described and shown in FIG. 4. The socket 350 is formed as a receiving part of three bayonet couplings enclosing a circular opening 306 for receiving the lighting module 302. The socket 350 may be mounted to the heat sink 340 by screws (not shown). Thus, as the lighting module 302 is connected to the socket 250, a thermal interface of the lighting module (provided at the bottom of the lighting module) is in direct contact with the heat sink 340, thereby enabling heat dissipation from the lighting module 302 to the heat sink 340. The socket may be designed in a similar way as the socket described in the second embodiment except that the electrical interface between the lighting module 302 and the socket 350 is different and the fastening of the lighting module 302 to the socket 350 may be made in a different way. The socket 350 has three L-shaped connected recesses 311, 312, 313 on its inner peripheral side which forms female parts of bayonet couplings. Each bayonet coupling 311, 312, 313 is used to position a different lighting module 302, which each may be adapted to a different voltage, for example to be operable with the North American, European or Japanese means supply. Within the area of the first L-shaped recess 311 at the bottom part of the opening on the socket is an anode 300 and a first cathode 341 arranged at a first angular distance (see D1 in FIG. 7*a*) from each other. A second cathode 342 is arranged at the area of the second L-shaped recess 312, at the bottom part of the opening on the socket, and a third cathode 343 is arranged at the area of the third L-shaped recess 312, at the bottom part of the opening on the socket. All three cathodes work together with the common anode 300. The second 342 and the third cathode 343 are arranged at a second and a third angular distance (see D2 resp. D3 in FIG. 7*a*) from the common anode 300. The first cathode 341 and the common anode 300 forms the first set of socket contact means 331. The second cathode 342 and the common anode 300 forms the second set of socket contact means 332. The third cathode 343 and the common anode 300 forms the third set of socket contact means 333. The first set of socket contact means 331 is adapted to a first voltage, for example to the mains supply in North America. The second set of socket contact means 332 is adapted to a second voltage, for example to the mains supply in European. The third set of socket contact means 333 is adapted to a third voltage, for example to the mains supply in Japan.

Figure 6B:
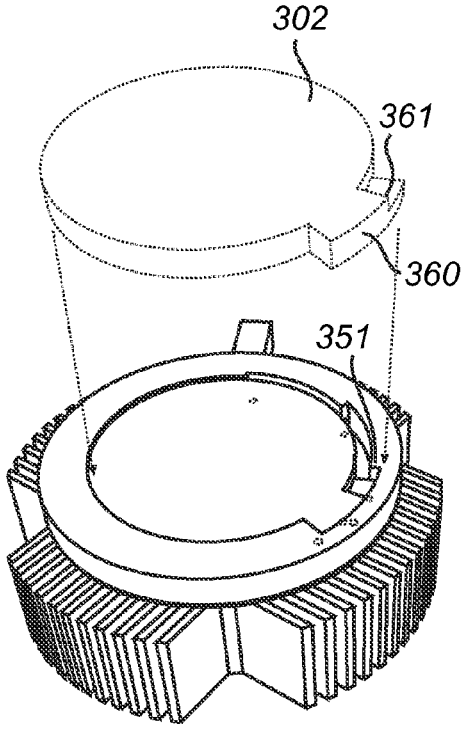
Figure 6C:
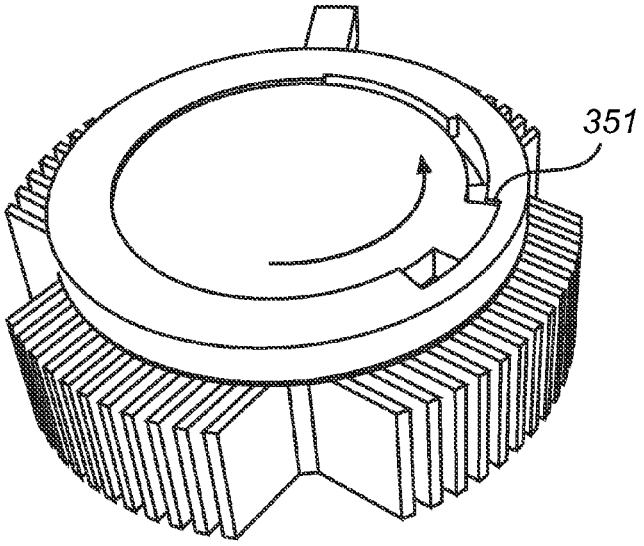

FIG. 6*b* shows the shape of the lighting module 302 (dotted lines) with a male part 360 protruding radially out from the lighting module to fit into the first female recess 311 in the socket 350. It will make electrical contact with the first set of socket contact means 331. The male part 360 has a cross section which is L-shaped and fits into the L-shaped female recess, and may work as a bayonet connection together. The lighting module is fitted into the opening 306 of the socket and the male part is arranged in the female opening in an axial direction of the socket. The width of the L-shaped male part is smaller than the opening i.e. insert of the female L-shaped part in order to arrange the male part into the female part. When arranged in the socket 350 the lighting module 302 is turned in the direction of the arrow in FIG. 6*c* until it hits with its side 361 a stop created by wall 351 of the L-shaped recess 311. The male part 360 has on its underside an anode and a cathode arranged (not shown) which will, when it is arranged in the correct position, i.e. when turned until it hits the stop, be in electrical contact with the anode 300 and the first cathode 341 of the first set of socket contact means 331. The anode and cathode may be accomplished by coding pins and when the lighting module is arranged in correct position the coding pins will press against electronic contact plates forming the anode and cathodes in the socket (not shown).

Figure 7A:
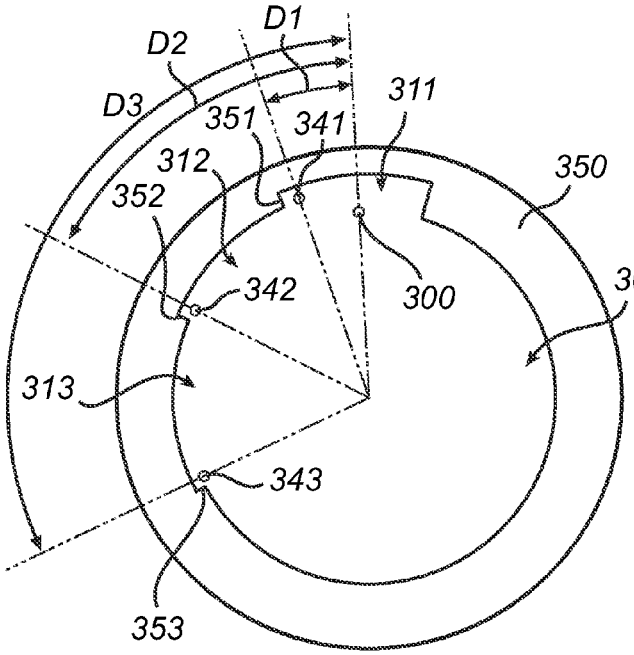
FIG. 7*a* shows a top view of the socket in FIGS. 6*a*-6*c*.

FIG. 7*a* shows the socket 350 from above with the opening 306 and the openings of the female L-shaped recess 311, 312, 313 in the inner wall of the socket 350. It shows the common anode 300 arranged in the area of the first shaped recess 311. It also shows the three different cathodes 341, 342, 343. Each female recess has a stop 351, 352, 353 which the L-shaped male part will hit when turned through rotation into place.

Figure 7B:
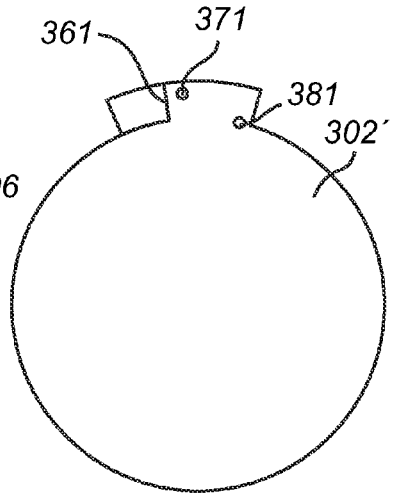
FIG. 7*b*-7*d* shows a top view of three different lighting modules in FIGS. 6*a*-6*c*.
Figure 7C:
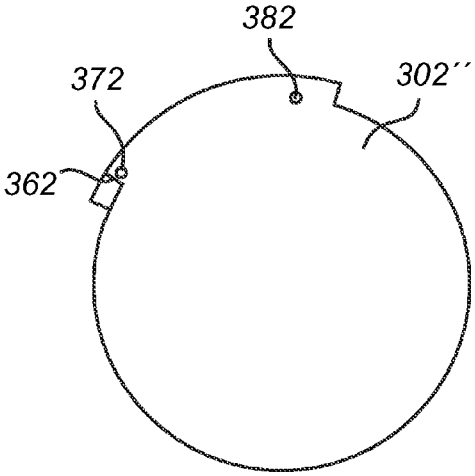

FIG. 7*b-c* shows three different shapes of the lighting module.

Figure 8A:
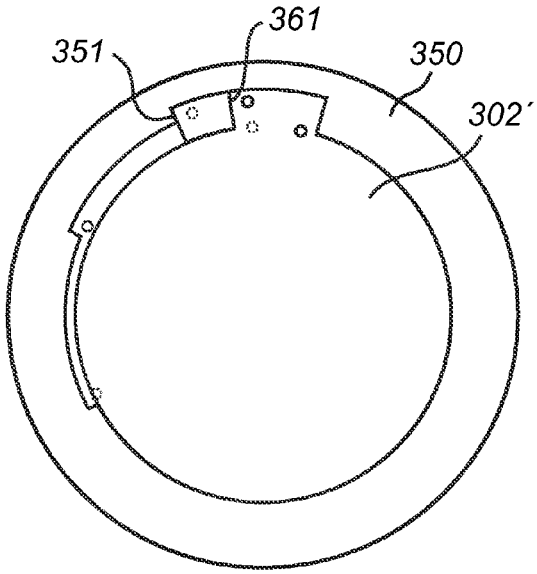
FIGS. 8*a* and 8*b* schematically illustrate how the socket in FIG. 7*a* interacts and electrically connects with the lighting module of FIG. 7*b*.
Figure 8B:
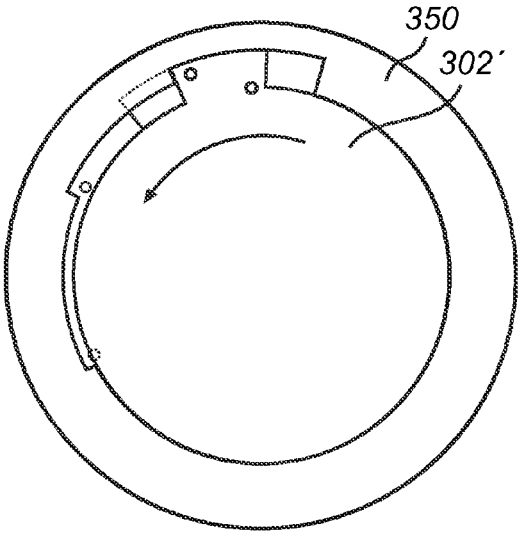

FIG. 7*b* shows a lighting module 302' which will fit into the first L-shaped recess 311 and make contact and it has an anode 381 and a cathode 371. The anode 381 when arranged in correct position in the socket 350 be arranged in contact with in the common anode 300, and the cathode 371 will be in electrical contact with the first cathode 341. The wall 361 of the male L-shaped part will hit wall 351 when the lighting module is arranged in a correct position and lie adjacent to each other in an assembled luminaire. This is shown in FIGS. 8*a* and 8*b*. FIG. 8*a* shows how the lighting module 302' is arranged in the socket 350 before rotating the lighting module 302' and FIG. 8*b* shows the situation when the lighting module 302' and the socket 350 make electrical contact. This lighting module 302' is adapted to the North American system.

Figure 9A:
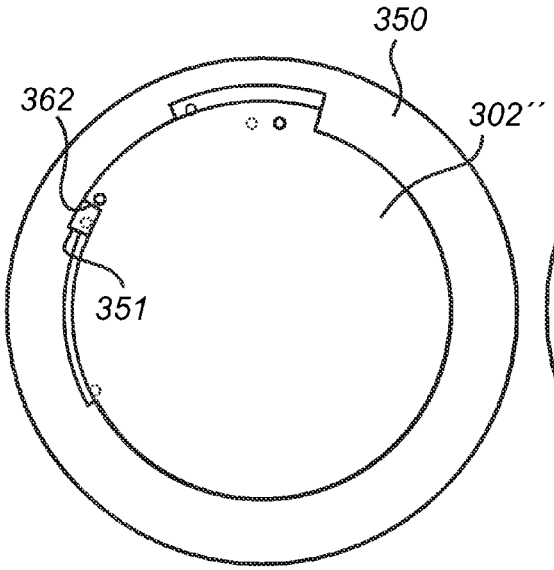
FIGS. 9*a* and 9*b* schematically illustrate how the socket in FIG. 7*a* interacts and electrically connects with the lighting module of FIG. 7*c*.
Figure 9B:
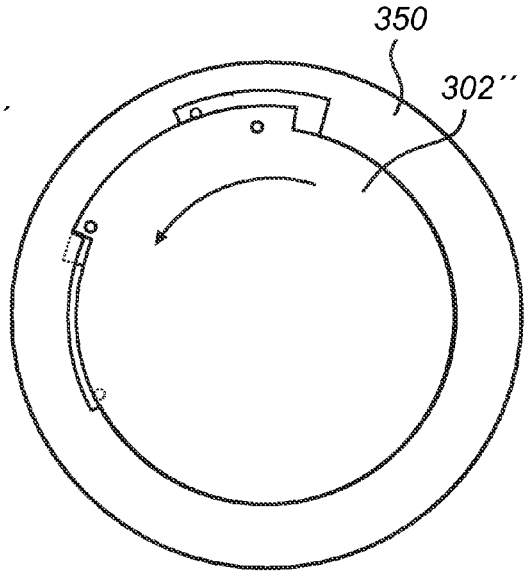

FIG. 7*c* shows a lighting module 302" which will fit into the second L-shaped recess 312 and which has an anode 382 and a cathode 372. The anode 382 when arranged in correct position in the socket 350 will be arranged in electrical contact with the common anode 300 and the cathode 372 will be in electrical contact with the second cathode 342. The wall 362 of the male L-shaped part will hit wall 352 when the lighting module is arranged in a correct position and will be adjacent to each other in an assembled luminaire. This is shown in FIGS. 9*a* and 9*b*. FIG. 9 shows how the lighting module 302" is arranged in the socket 350 before rotating the lighting module 302" and FIG. 9*b* shows the situation when they make electrical contact. This lighting module 302" is adapted to the European system.

Figure 7D:
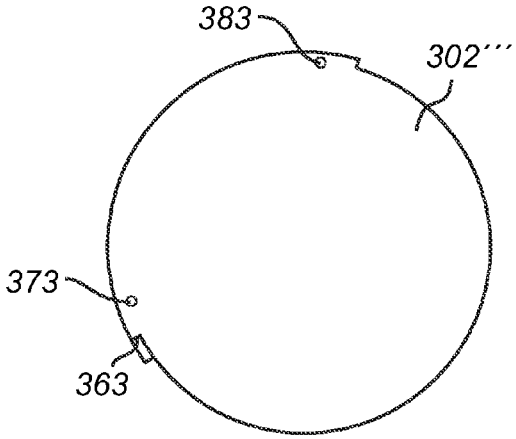
Figure 10A:
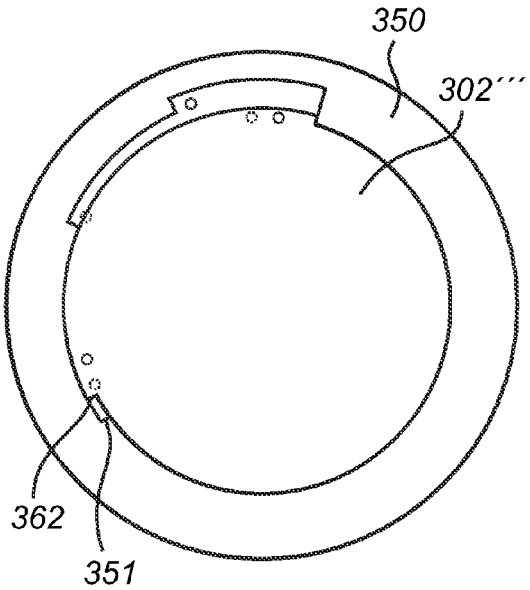
FIGS. 10*a* and 10*b* schematically illustrate how the socket in FIG. 7*a* interacts and electrically connects with the lighting module of FIG. 7*d*.
Figure 10B:
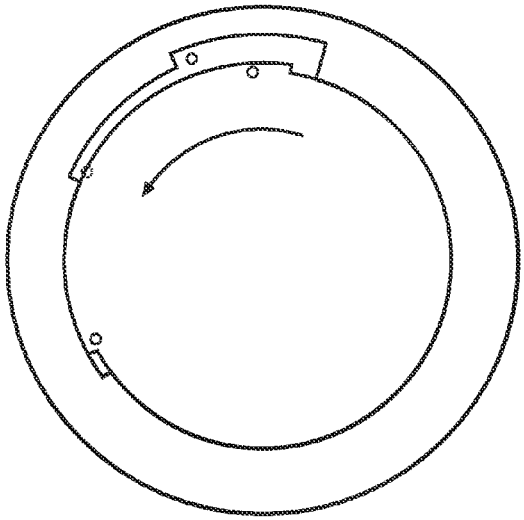

FIG. 7*d* shows a lighting module 302" which will fit into the third L-shaped recess 313 and it has an anode 383 and a cathode 373. The anode 383 when arranged in correct position in the socket 350 will be arranged in electrical contact with the common anode 300 and the cathode 373 will be in electrical contact with the third cathode 342. The wall 363 of the male L-shaped part will hit wall 353 when the lighting module is arranged in a correct position and will be adjacent to each other in an assembled luminaire. This is shown in FIGS. 10*a* and 10*b*. FIG. 10*a* shows how it is arranged in the socket before rotating the lighting module 302'" and FIG. 10*b* shows the situation when they make electrical contact. This lighting module 302'" is adapted to the Japanese system. It is however realized that these lighting modules 302', 302", 302'" in FIG. 7*b-d* may be adapted to other mains supplied than mentioned. For example the one described in FIG. 7*b* may adapt for the Japanese system or the European system etc.

If a socket 350 is installed in North America and the first set of socket contact means 331 is connected to the mains supply in North America and a European light module 302" as shown in FIG. 7*c* is arranged into the socket 350, no electrical contact will be made since the second cathode 342 in the socket will not be connected to the mains supply. Electrical contact will only be made if a lighting module adapted to the North American market is arranged into the socket, which will have its anode and cathode at a corresponding position as the anode and cathode in the socket. The anodes and the cathodes in the socket and/or the lighting module may be realized by slide connectors or spring loaded contacts and/or coding pins and/or electrical plates. This system creates closed electrical circuits, however it might be possible to design the system so that it creates open circuits. Then, however, all the circuits have to be opened except the desired one. Further, it is possible to connect all sets of socket contacts means in parallel so as to prevent any mistakes in connections during assembly and installation.

Figure 11:
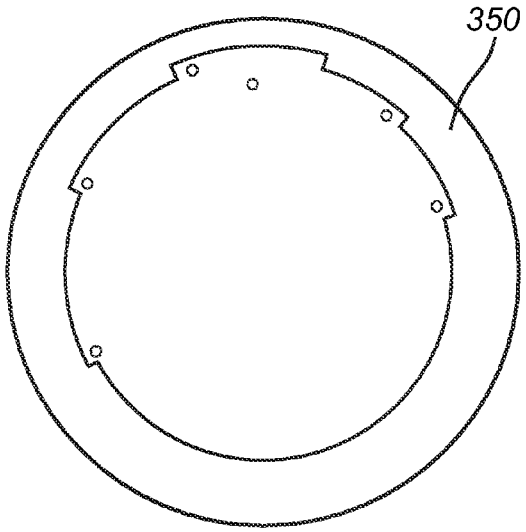
FIG. 11 shows a second variant socket of the third embodiment of the present invention.

FIG. 11 shows a socket 350 which has more than three female bayonet connections each with its own cathode and, together with the common anode, forming a fourth set of socket contact means and a fifth set of socket contact means in order to connect more than three different light modules.

The person skilled in the art realizes that the present invention by no means is limited to the preferred embodiments described above. On the contrary, many alterations, modifications and variations are possible within the scope of the appended claims. For example, other solid state light sources than LEDs may be used, e.g. lasers or laser diodes. Further, the connector may be used for any electrical interface, being an AC mains voltage, a low voltage AC voltage or a DC voltage. Additionally, the mechanical connection may be made in other ways such as by using screw threads.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. A socket for receiving a lighting module comprising a light source, electrical contacting means electrically connected to the light source and a heat spreader in thermal contact with the light source, the socket comprising at least a first set and a second set of socket contact means for providing an electrical interface with the electrical contacting means of the lighting module, and a track in which the first set and the second set of socket contact means are arranged and at least one of the first set and the second set of socket contact means being accessible through at least a part of the track, wherein the socket is configured to retain the lighting module in a predetermined position in which electrical contact between the electrical contacting means of the lighting module and one of the first and second set of socket contact means is achieved and electrical contact between the electrical contacting means of the lighting module and the other one of the first and second set of socket contact means is prevented.

2. The socket according to claim 1, wherein the predetermined position is defined by the location of one of the first set or the second set of socket contact means on the socket.

3. The socket according to claim 1, wherein the first set (231, 331) and the second set (232, 332) of socket contact means are electrically connectable to the electrical contacting means (215, 381; 371, 382; 372, 383; 373) of the lighting module (202, 302', 302", 302'") through rotation of the lighting module (202, 302', 302", 302'").

4. The socket according to any one of claims 1, wherein the second set of socket contact means of the socket defines a second predetermined position of the lighting module in the socket when the first set of contact means defines the first predetermined position.

5. The socket according to claim 1, wherein the track has a first and a second side track from a common track and the first set of socket contact means is provided in the first side track and the second set of socket contact means is provided in the second side track.

6. The socket according to claim 1, wherein the first set of socket contact means comprises a first anode and a first cathode arranged in the socket at a first angular distance (D1) and the second set of contact means comprises the same first anode and a second cathode arranged at a second angular distance (D2) and the electrical contacting means of the lighting module comprises a lighting module anode and a lighting module cathode in a position corresponding to the position of the first anode and first or second cathode of the first set or second set of socket contact means in order to make electrical contact with the corresponding first anode and first or second cathode.

7. The socket according to claim 1, wherein the first set and second set of socket contact means are slide connectors or spring loaded contacts or electrical contact plates.

8. A lighting module to be received in a socket according to claim 1, the lighting module comprising a light source, electrical contacting means electrically connected to the light source and a heat spreader in thermal contact with the light source, wherein the electrical contacting means are arranged to exclusively connect with the first set or the second set of contact means of the socket when received by the socket in the predetermined position.

9. The lighting module according to claim 1, wherein the light source is a light emitting diode.

10. The socket according to claim 1, wherein each set of socket contact means is adapted to predetermined and different voltages.

11. The socket according to claim 1, wherein first set and the second set of socket contact means are reached through rotation of the lighting module in different directions.

12. The socket according to claim 11 wherein the socket comprises a twist stop.

* * * * *